US011391168B2

(12) United States Patent
Hagita et al.

(10) Patent No.: US 11,391,168 B2
(45) Date of Patent: Jul. 19, 2022

(54) GAS TURBINE COMBUSTOR AND TRANSITION PIECE ASSEMBLY

(71) Applicant: Mitsubishi Heavy Industries, Ltd., Tokyo (JP)

(72) Inventors: Tatsuya Hagita, Yokohama (JP); Noboru Okuyama, Yokohama (JP); Yasuhiro Wada, Yokohama (JP); Yasuyuki Watanabe, Yokohama (JP); Shohei Yoshida, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 62 days.

(21) Appl. No.: 16/260,854

(22) Filed: Jan. 29, 2019

(65) Prior Publication Data

US 2019/0264571 A1 Aug. 29, 2019

(30) Foreign Application Priority Data

Feb. 28, 2018 (JP) ..... JP2018-034887

(51) Int. Cl.
*F01D 9/02* (2006.01)
*F23R 3/60* (2006.01)
(Continued)

(52) U.S. Cl.
CPC ..... *F01D 9/023* (2013.01); *F23R 3/425* (2013.01); *F23R 3/60* (2013.01); *F01D 11/005* (2013.01);
(Continued)

(58) Field of Classification Search
CPC ..... F01D 9/023; F01D 11/005; F23R 3/425; F23R 3/60; F23R 2900/00012; F05D 2230/64; F05D 2240/55
See application file for complete search history.

(56) References Cited

U.S. PATENT DOCUMENTS 3,989,410 A 11/1976 Ferrari
4,465,284 A * 8/1984 Szema ..... F01D 9/023 277/628
(Continued)

FOREIGN PATENT DOCUMENTS

CN 102144076 A 8/2011
CN 103104349 A 5/2013
(Continued)

OTHER PUBLICATIONS

Korean-language Office Action issued in counterpart Korean Application No. 10-2019-0011880 dated Jan. 21, 2020 with English translation (seven (7) pages).
(Continued)

*Primary Examiner* — William H Rodriguez
*Assistant Examiner* — Henry Ng
(74) *Attorney, Agent, or Firm* — Crowell & Moring LLP

(57) ABSTRACT

A gas turbine combustor is equipped with a transition piece assembly of the combustor, the transition piece assembly includes a transition piece, a frame which is installed on the downstream side (an outlet part) of the transition piece and a seal member which is installed on a coupled part of the aforementioned frame and a turbine-side stator vane part and blocks flowing of compressed air from a compressor into the aforementioned turbine side through a gap of the coupled part, and a projection member is provided on an outer circumference of the aforementioned frame, a movement suppression mechanism for matching the aforementioned projection member and suppressing possible movement of the aforementioned seal member is provided on the aforementioned seal member, the movement suppression mechanism and the aforementioned projection members fit together and thereby the aforementioned seal member is fixed to the frame.

5 Claims, 7 Drawing Sheets

(51) Int. Cl.
*F23R 3/42* (2006.01)
*F01D 11/00* (2006.01)

(52) U.S. Cl.
CPC ..... *F05D 2230/64* (2013.01); *F05D 2240/55* (2013.01); *F23R 2900/00012* (2013.01)

(56) References Cited

U.S. PATENT DOCUMENTS

| | | | | |
|---|---|---|---|---|
| 5,265,412 | A * | 11/1993 | Bagepalli | F02K 1/805 277/355 |
| 5,400,586 | A * | 3/1995 | Bagepalli | F23R 3/60 277/355 |
| 5,749,218 | A | 5/1998 | Cromer et al. | |
| 6,450,762 | B1 | 9/2002 | Munshi | |
| 6,463,742 | B2 | 10/2002 | Mandai et al. | |
| 6,751,962 | B1 * | 6/2004 | Kuwabara | F01D 9/023 60/752 |
| 9,879,605 | B2 | 1/2018 | Maurer et al. | |
| 2002/0163134 | A1 * | 11/2002 | Cromer | F16J 15/3288 277/411 |
| 2003/0066292 | A1 | 4/2003 | Mack et al. | |
| 2004/0031270 | A1 | 2/2004 | Sileo et al. | |
| 2008/0010989 | A1 | 1/2008 | Kato et al. | |
| 2008/0053107 | A1 | 3/2008 | Weaver et al. | |
| 2008/0202124 | A1 * | 8/2008 | Sutcu | F01D 9/023 60/796 |
| 2010/0061837 | A1 | 3/2010 | Zborovsky et al. | |
| 2010/0247286 | A1 * | 9/2010 | Maldonado | F01D 5/186 415/1 |
| 2011/0048030 | A1 * | 3/2011 | Berry | F01D 9/023 60/806 |
| 2012/0200046 | A1 | 8/2012 | Green et al. | |
| 2012/0292860 | A1 * | 11/2012 | Moehrle | F01D 9/023 277/640 |
| 2013/0045090 | A1 * | 2/2013 | Pruthi | F01D 9/023 415/173.7 |
| 2013/0111912 | A1 | 5/2013 | Flanagan et al. | |
| 2013/0227964 | A1 * | 9/2013 | Willis | F01D 9/023 60/806 |
| 2015/0128610 | A1 * | 5/2015 | Salunkhe | F01D 9/023 60/800 |

FOREIGN PATENT DOCUMENTS

| | | | |
|---|---|---|---|
| EP | 1 239 118 | A2 | 9/2002 |
| EP | 1 507 015 | A1 | 2/2005 |
| FR | 2 422 037 | A1 | 11/1979 |
| JP | 60-30431 | A | 2/1985 |
| JP | 2001-349544 | A | 12/2001 |
| JP | 2003-185140 | A | 7/2003 |
| JP | 2003-193866 | A | 7/2003 |
| JP | 2004-301115 | A | 10/2004 |
| JP | 2006-214671 | A | 8/2006 |
| JP | 2006-284127 | A | 10/2006 |
| WO | WO 2016/068857 | A1 | 5/2016 |

OTHER PUBLICATIONS

Extended European Search Report issued in counterpart European Application No. 19154081.4 dated Jul. 9, 2019 (six (6) pages).

Russian-language Office Action issued in counterpart Russian Application No. 2019102066/06(003610) dated Oct. 21, 2019 with English translation (14 pages).

Chinese-language Office Action issued in Chinese Application No. 20191007912.8 dated Mar. 26, 2020 with English translation (13 pages).

Hindi-language Office Action issued in Indian Application No. 201914003403 dated Dec. 18, 2020 with English translation (6 pages).

Japanese-language Office Action issued in Japanese Application No. 2018-034887 dated Jun. 29, 2021 with English translation (10 pages).

* cited by examiner

GAS TURBINE COMBUSTOR AND TRANSITION PIECE ASSEMBLY

CLAIM OF PRIORITY

The present application claims priority from Japanese Patent application serial No. 2018-34887, filed on Feb. 28, 2018, the content of which is hereby incorporated by reference into this application.

TECHNICAL FIELD

The present invention concerns a gas turbine combustor and a transition piece assembly and, in particular, relates to the gas turbine combustor and the transition piece assembly which are favorable for the one that, on outer circumferences of coupled parts of a turbine stator vane of a gas turbine and a frame which is installed on an outlet part of a transition piece, a seal member for sealing so as not to flow compressed air from a compressor into the turbine side through a gap between the above-described coupled parts is installed.

BACKGROUND ART

In general, the gas turbine is configured by being equipped with the compressor, the combustor and the turbine and is made in such a manner that air compressed by the compressor is supplied to the combustor, the compressed air and a fuel supplied from other are mixed and burned to generate a combustion gas in the combustor and the combustion gas is expanded by the gas turbine.

A plurality of the combustors is installed in a circumferential direction of the turbine and a mixed fluid of the fuel and air is combusted in an upstream area of the transition piece in each combustor and the combustion gas is sent from the transition piece to a first-stage stator vane part on the gas turbine side.

Incidentally, since it is structured in such a manner that although the compressed air from the compressor is supplied to the combustor which is housed in a combustor casing, the compressed air is sent around the combustor including the transition piece, performs cooling and thereafter is supplied to the combustor, there has been a fear that the compressed air from the compressor might flow into the turbine side through a gap between the coupled parts of the transition piece and the first-stage stator vane part on the gas turbine side and operating efficiency of the gas turbine might be worsened due to a reduction in temperature of the combustion gas, useless consumption of the air which is not involved in combustion and so forth.

From such things, a seal member which seals the gap between the first-stage stator vane part on the turbine side and the outlet side of the transition piece is adopted on the coupled parts of the transition piece and the turbine side of the gas turbine combustor in such a manner that the compressed air from the compressor does not flow into the turbine side through a gap between the coupled parts and this seal member is generally mounted on the frame which is installed on the outlet part of the transition piece.

The ones that the seal member (including a floating seal material and a side seal material) which seals the gap between the first-stage stator vane part on the turbine side and the outlet side of the transition piece in such a manner that the compressed air from the above-described compressor does not flow into the turbine side through a gap between the coupled parts is mounted on the frame which is installed on the outlet part of the transition piece are described in Japanese Unexamined Patent Application Publication No. 2006-214671 (Patent Literature 1) and Japanese Unexamined Patent Application Publication No. 2003-193866 (Patent Literature 2).

In these Patent Literatures 1 and 2, it is disclosed that the transition piece is formed into a cylindrical shape at an inlet and into an inverted trapezoidal shape at an outlet, the frame of a shape which matches the inverted trapezoidal shape of the outlet of the transition piece is installed on the downstream side of this transition piece, the outlet side of the frame which is formed into the inverted trapezoidal shape is connected to the stator vane part on the turbine side and a frame seal groove is formed in an outer circumference on the outlet side of the aforementioned frame, the floating seal materials which are the seal members which float are engaged with top and bottom of this frame seal groove and the side seal materials which are the seal members are mounted on the both sides of the frame seal groove, and it is described that the floating seal material is engaged therewith with one end which is formed into a U-shape being inserted into the frame seal groove, an engagement side which extends at a right angle outward from an U-shaped leading end part is formed on the other end thereof and this engagement side is engaged therewith by being inserted into a stator vane seal groove which is formed in the first-stage stator vane part of the gas turbine which is located so as to face the frame on the downstream side of the transition piece.

SUMMARY OF THE INVENTION

Technical Problem

Incidentally, in the gas turbine combustors in the above-described Patent Literatures 1 and 2, when the floating seal material is made movable in the turbine circumferential direction and an axial direction with vibrations caused by combustion and flowing of the combustion gas, sliding occurs between the U-shaped leading end part of the floating seal material and the frame which is a mating-side member and, in particular, in a case where the vibration has generated in members which are inserted into the seal groove and built up by engagement as in Patent Literatures 1 and 2, there is a fear that wear may occur on contact parts of the mating members and wear damage may occur under a high temperature.

The present invention has been made in view of the above-described points and an object thereof is to provide a gas turbine combustor and a transition piece assembly which are able to suppress possible movement of the seal member in the turbine circumferential direction and the axial direction and to prevent occurrence of wear on the contact parts of the mating members even when there exist the vibrations caused by combustion and flowing of the combustion gas.

Solution to Problem

In order to attain the above-described object, a gas turbine combustor of the present invention is the gas turbine combustor which is equipped with a transition piece assembly of the combustor, the transition piece assembly of the combustor includes a transition piece in which a high-temperature combustion gas flows, a frame which is installed on the downstream side (an outlet part) of the transition piece and a seal member which is installed on a coupled part of the aforementioned frame and a stator vane part on the turbine side and blocks flowing of compressed air from a compressor into the aforementioned turbine side through a gap of the coupled part, and a projection member is provided on an outer circumference of the aforementioned frame, a movement suppression mechanism for matching the aforementioned projection member and suppressing possible movement of the aforementioned seal member is provided on the aforementioned seal member, the aforementioned movement suppression mechanism and the aforementioned projection member fit together and thereby the aforementioned seal member is fixed to the frame.

In addition, in order to attain the above-described object, a transition piece assembly of the present invention is the transition piece assembly of a combustor which includes a transition piece in which a high-temperature gas flows, a frame which is installed on the downstream side (an outlet part) of the transition piece, and a seal member which is installed on a coupled part of the aforementioned frame and a turbine-side stator vane part and blocks flowing of compressed air from a compressor into the aforementioned turbine side through a gap of the aforementioned coupled part, a projection member is provided on an outer circumference of the aforementioned frame, a movement suppression mechanism for matching the aforementioned projection member and suppressing possible movement of the aforementioned seal member is provided on the aforementioned seal member, the aforementioned movement suppression mechanism and the aforementioned projection member fit together and thereby the aforementioned seal member is fixed to the frame.

Advantageous Effects of Invention

According to the present invention, possible movement of the seal member in the turbine circumferential direction and the axial direction can be suppressed and thereby occurrence of wear on the contact parts of the mating members can be prevented even when there exist the vibrations caused by combustion and flowing of the combustion gas.

DESCRIPTION OF EMBODIMENTS

In the following, a gas turbine combustor and a transition piece of the present invention will be described on the basis of illustrated embodiments. Incidentally, in the respective embodiments which will be described in the following, the same symbols are used for the same components.

Embodiment 1

Figure 1:
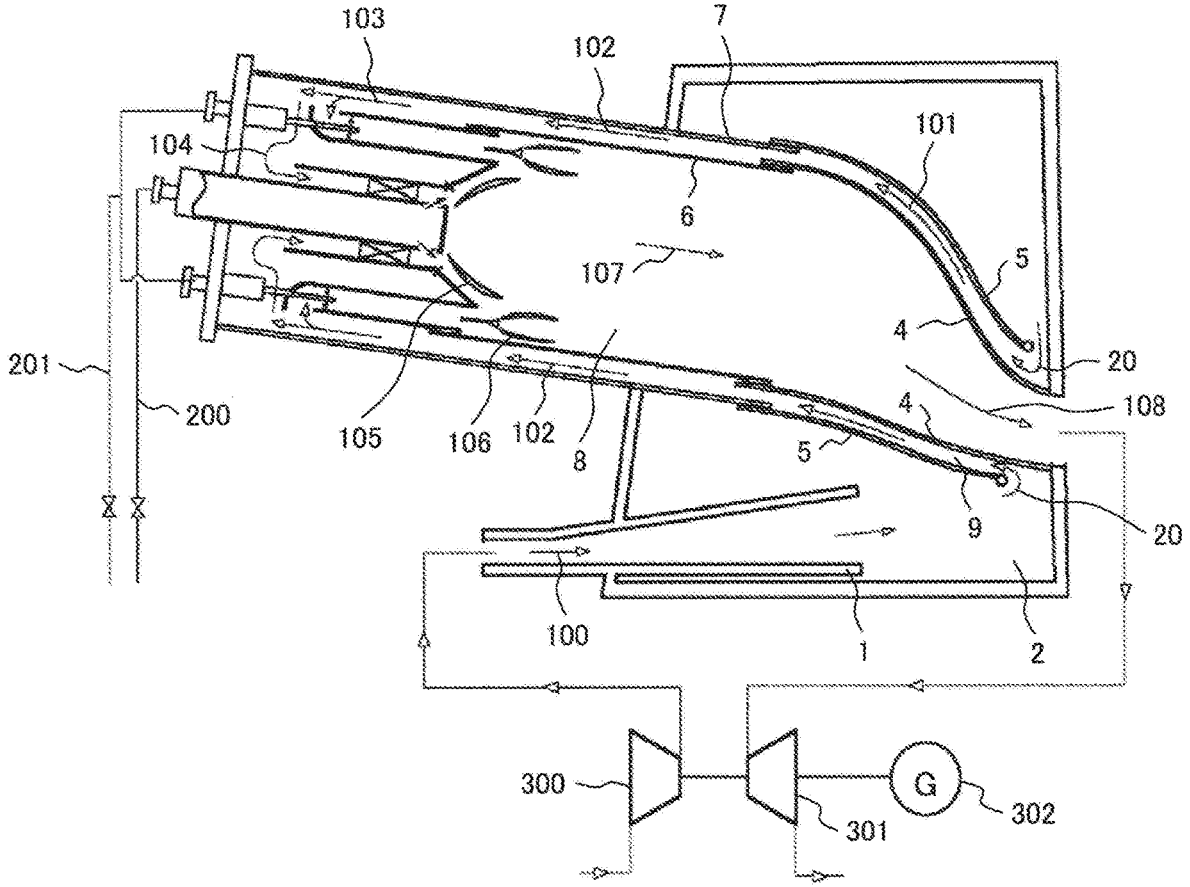
FIG. 1 is a diagram illustrating an entire configuration of a gas turbine combustor according to an embodiment 1 of the present invention.

An entire configuration of a power-plant-oriented gas turbine combustor is illustrated in FIG. 1 as one example of the gas turbine combustor of the present invention.

As illustrated in FIG. 1, the gas turbine combustor is roughly configured by a transition piece 4 of the combustor in which a high-temperature combustion gas 107 flows, a transition piece flow sleeve 5 which is present around this transition piece 4 and includes the transition piece 4 therein, a flow passage 9 which is formed between this transition piece flow sleeve 5 and the transition piece 4 and through which high-temperature and high-pressure compressed air 100 which has been exhaled from a compressor 300 flows, a liner 6 which is connected to the transition piece 4 and a liner flow sleeve 7 which is connected to the transition piece flow sleeve 5, is installed concentrically on an outer circumference of the liner 6 and thereby forms a gap through which a flow 102 of the compressed air passes.

Then, the compressed air 100 which has been introduced from the compressor 300 is introduced into a casing 2 through a diffuser 1 and flows into a gap (the flow passage 9) which is formed by the transition piece flow sleeve 5 and the transition piece 4 (illustrated by an arrow 20).

That is, the compressed air 100 which has been introduced into the cashing 2 through the diffuser 1 becomes a flow 20 which enters the flow passage 9 which is formed by the transition piece flow sleeve 5 and the transition piece 4 through an opening formed in a downstream-side end of the transition piece flow sleeve 5.

Thereafter, the compressed air 100 which has flown into the flow passage 9 becomes a flow 102 which passes through the gap between the liner 6 and the liner flow sleeve 7 which is installed concentrically on the outer circumference of the liner 6 as indicated by a flow 101. Then, the flow is reversed, becomes flows 103, 104 which is introduced into a burner part, is mixed with a fuel supplied from fuel systems 200, 201, forms flames 105, 106 in a combustion chamber 8 in the liner 6 and becomes a high-temperature and high-pressure combustion gas 107. Thereafter, although it becomes a combustion gas 108 which is introduced from the transition piece 4 into a turbine 301, in the gas turbine, an output is obtained from a power generator 302 by converting an amount of work that the high-temperature and high-pressure combustion gas 108 generates when it adiabatically expands into axial rotation force in the turbine 301. Incidentally, the illustrated combustor is configured by a premixed combustion burner (a main burner) and a diffusion combustion burner (a pilot burner), the fuel system which supplies the fuel to the premixed burner is displayed as the symbol 201 and the fuel system which supplies the fuel to the diffusion combustion burner is displayed as the symbol 200.

Incidentally, although the compressed air 100 from the compressor 300 is supplied to the combustor, it is structured in such a manner that the compressed air 100 is sent around the combustor including the transition piece 4, performs cooling and thereafter is supplied to the combustor. Then, when the compressed air 100 from the compressor 300 leaks to the turbine side through a gap between coupled parts of the transition piece 4 and a first-stage stator vane part 14 on the turbine side (see FIG. 3), a leaking portion thereof does not contribute to cooling of the transition piece 4 and generation of the combustion gas 107 and becomes a factor of lowering operating efficiency of the gas turbine. Therefore, a seal member 10 (see FIG. 2 and FIG. 3) which seals the gap between the first-stage stator vane part 14 on the turbine side and the outlet side of the transition piece 4 is adopted on the coupled parts of the transition piece 4 and the turbine side of the gas turbine combustor in such a manner that the compressed air 100 from the compressor 100 does not flow out to the turbine side through a gap between the coupled parts and, in general, this seal member 10 is mounted on a frame 11 (see FIG. 2 and FIG. 3) which is installed on the outlet part of the transition piece 4.

Figure 2:
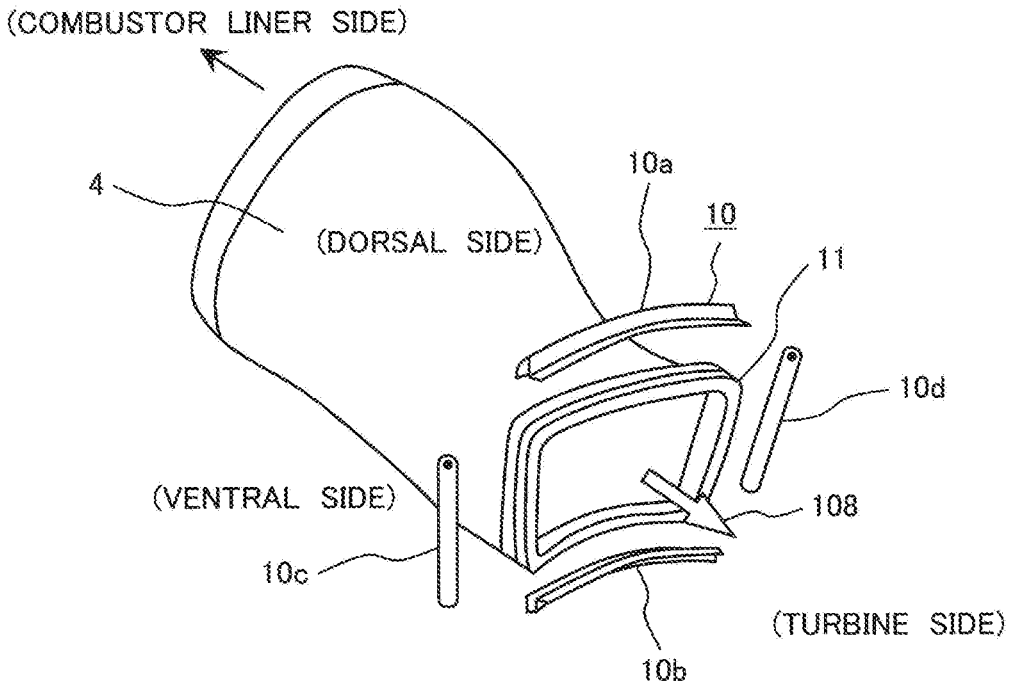
FIG. 2 is a perspective view illustrating the outlet side of a transition piece which is adopted in the embodiment 1 of the gas turbine combustor of the present invention by dismantling a seal member.

The seal member 10 and the frame 11 will be described by using FIG. 2. FIG. 2 illustrates details of the outlet side of the transition piece 4.

As illustrated in FIG. 2, the seal member 10 includes floating seal materials 10*a*, 10*b* and side seal materials 10*c*, 10*d*, the transition piece 4 is formed into a cylindrical shape at an inlet (the combustor liner side) of the combustion gas and into an inverted trapezoidal shape at an outlet (the turbine side), the frame 11 of a shape which matches the inverted trapezoidal shape of the outlet of the transition piece 4 is installed on the downstream side (the turbine side) of this transition piece 4 and the outlet side of the frame 11 which is formed into the inverted trapezoidal shape is connected to the first-stage stator vane part 14 (a turbine inlet part) on the turbine side. Then, the floating seal materials 10*a*, 10*b* are mounted on the upper and lower sides (the radial-direction inner side and outer side) of this frame 11 and the side seal materials 10*c*, 10*d* are mounted on the lateral sides thereof.

Next, a structure of fixing the seal member 10 to the frame 11 in the present embodiment will be described by using FIG. 3, FIG. 4, FIG. 5, FIG. 6 and FIG. 7.

Figure 3:
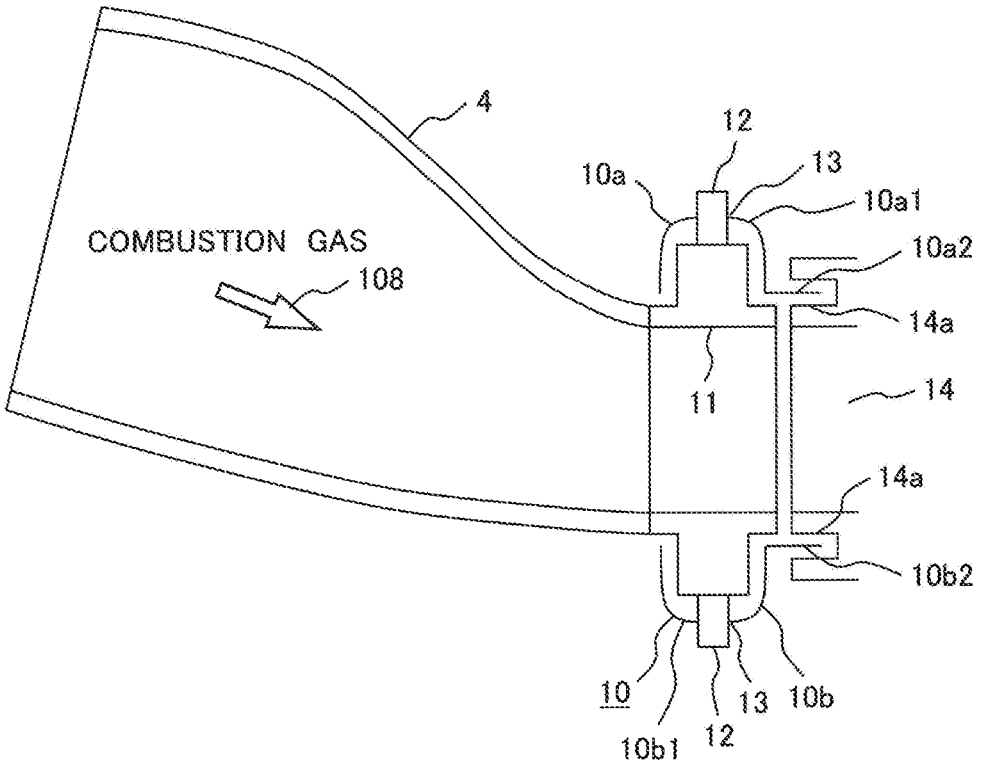
FIG. 3 is a diagram illustrating a joined part between a frame of the transition piece and a first-stage stator vane of the turbine which are adopted in the embodiment 1 of the gas turbine combustor of the present invention.
Figure 4:
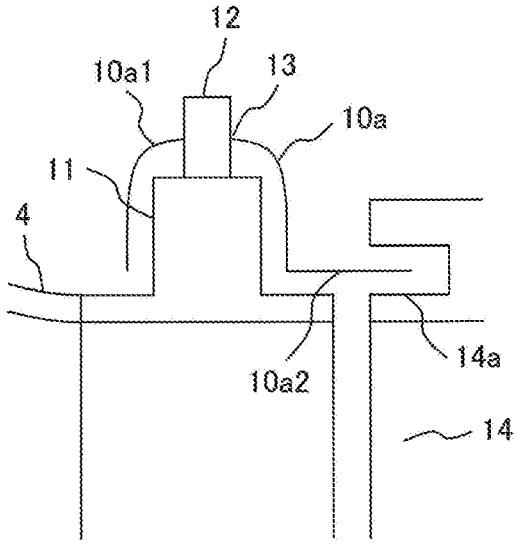
FIG. 4 is a partially enlarged diagram illustrating details of the joined part between the frame of the transition piece and the first-stage stator vane of the turbine in FIG. 3.
Figure 5:
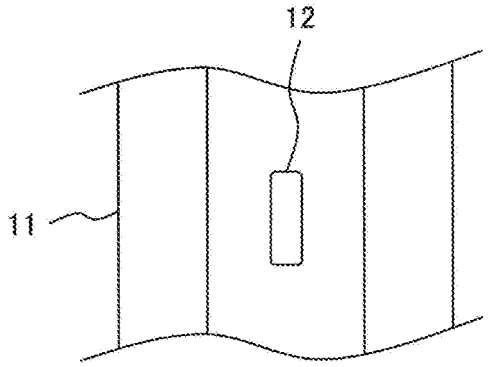
FIG. 5 is a plan view illustrating a state where a projection member which is installed on the frame of the transition piece in FIG. 3 is fitted into a through-hole formed in a seal material.
Figure 6:
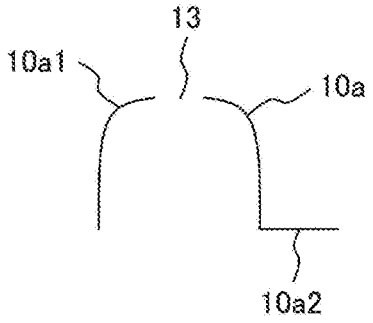
FIG. 6 is a diagram illustrating the seal material which is adopted in the embodiment 1 of the gas turbine combustor of the present invention.
Figure 7:
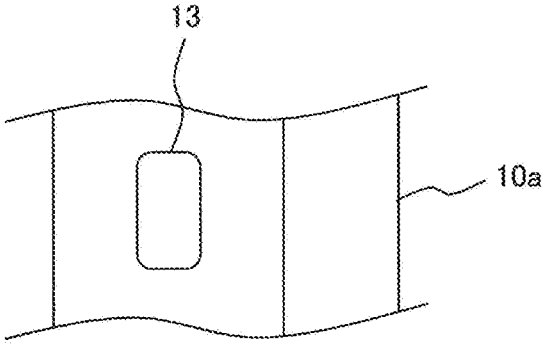
FIG. 7 is a plan view of FIG. 6.

As illustrated in FIG. 3 and FIG. 4, in the present embodiment, a projection member 12 (see FIG. 5) which extends outward and inward (a top-bottom direction in FIG. 3 and FIG. 4) in a radius direction of the transition piece 4 is provided on an outer circumference of the frame 11 and a through-hole 13 (an opening of a shape corresponding to an outer shape of the projection member 12 viewing from an extending direction) which matches this projection member 12 is provided in the floating seal materials 10*a*, 10*b*, the projection member 12 is fitted into the through-hole 13 in the floating seal materials 10*a*, 10*b* and thereby the floating seal materials 10*a*, 10*b* are fixed.

The above-described floating seal materials 10*a*, 10*b* are configured by fix parts 10*a*1, 10*b*1 which are fixed to the frame 11 and seal parts 10*a*2, 10*b*2 which seal between the coupled parts of the transition piece 4 and the turbine. The fix parts 10*a*1, 10*b*1 are formed into, for example, U-shapes such as those illustrated in FIG. 3, FIG. 4 which are shapes which arcuately curve along protruded parts which are provided on the radius-direction inner side and outer side of the frame 11. In addition, the through-hole 13 is formed in the fix parts 10*a*1, 10*b*1 at positions where it corresponds to the aforementioned projection member 12 when mounted on the frame 11. In examples illustrated in FIG. 3, FIG. 4, the through-hole 13 is formed at positions on top parts of the fix parts 10*a*1, 10*b*1 which curve into the U-shapes.

In addition, the seal parts 10*a*2, 10*b*2 which seal the coupled parts of the transition piece 4 and the turbine inlet are connected to the downstream sides (right-hand sides of FIG. 3, FIG. 4) of the fix parts 10*a*1, 10*b*1. These seal parts 10*a*2, 10*b*2 are engagement pieces which bend at a right angle from terminal parts on the downstream sides of the U-shaped fix parts 10*a*1, 10*b*1 and extend to the downstream sides along an outer surface of the outlet part of the frame 11.

Then, a seal groove 14*a* whose opening part is formed on the upstream side of a combustion gas flowing direction is provided in a face which faces the frame 11 on the turbine side. This seal groove 14*a* is formed in the face which faces the frame 11 by extending in a circumferential direction of the turbine. The downstream sides of the seal parts 10*a*2, 10*b*2 of the floating seal materials 10*a*, 10*b* are inserted into the seal groove 14*a*. The seal parts 10*a*2, 10*b*2 are fitted into this seal groove 14*a* and thereby a gap in a bonded part which is formed along the circumferential direction of the turbine is sealed. In addition, since the projection member 12 is fitted into the through-hole 13, movement of the floating seal materials 10*a*, 10*b* relative to the circumferential direction of the turbine can be restricted.

Thereby, it is structured in such a manner that the compressed air 100 is prevented from flowing into the turbine flow passage through an axial-direction gap between the coupled parts of the frame 11 on the downstream side of the transition piece 4 and the first-stage stator vane part 14 (see FIG. 3) on the gas turbine side and the floating seal materials 10*a*, 10*b* do not fall off.

The shape of the above-described projection member q12 is, for example, a rectangular parallelepiped shape and is the one that rounding is performed on a side-face side thereof. In addition, even when the shape of the projection member 12 is columnar and the number of the projection members 12 is two or more, the effect of the present embodiment is not impaired.

Incidentally, the turbine circumferential-direction inner circumference side (the ventral side) and outer circumference side (the dorsal side) of the frame 11 illustrated in FIG. 2 are formed into shapes which bend in a circular arc so as to match the flow passage in which the first-stage stator vane 14 on the turbine side is installed.

Owing to the configuration of the present embodiment like this, that is, owing to fitting of the projection member 12 provided on the frame 11 and the through-hole 13 formed in the floating seal materials 10*a*, 10*b*, possible movement of the floating seal materials 10*a*, 10*b* in the turbine circumferential direction and axial direction is suppressed.

In addition, since the turbine circumferential-direction possible movement of the floating seal materials 10*a*, 10*b* is determined only by fitting faces of the through-hole 13 and the projection member 12, a turbine circumferential-direction possible movement range, that is, position accuracy of the floating seal materials 10*a*, 10*b* can be managed only by management of accuracy of the fitting faces of the through-hole 13 and the projection member 12.

Therefore, according to the configuration of the present embodiment, suppression of amounts of the turbine circumferential-direction possible movement of the floating seal materials 10*a*, 10*b* is facilitated and it is advantageous for maintaining the position accuracy high.

In addition, when incorporating the transition piece 4 into the casing 2 of the gas turbine, even when a space in the casing 2 is small, the floating seal materials 10*a*, 10*b* and the side seal materials 10*c*, 10*d* can be incorporated thereinto by mounting in advance the floating seal materials 10*a*, 10*b* and the side seal materials 10*c*, 10*d* on the frame 11.

At this time, gaps that tolerance for incorporation is taken into consideration in the turbine circumferential direction are necessary between the adjacent floating seal materials 10*a*, 10*b* in order not to allow contact of the mating floating seal materials 10*a*, 10*b* of the adjacent combustor cans.

Since in the present embodiment, since the position accuracy of the floating seal materials 10*a*, 10*b* in the turbine circumferential direction can be maintained high by holding the floating seal materials 10*a*, 10*b* by fitting of the projection member 12 and the through-hole 13, the turbine circumferential-direction gaps between the adjacent floating seal materials 10*a*, 10*b* can be made small. As a result, sealability can be maintained high and low NOx and backfire prevention can be realized.

Further, the possible movement amounts of the floating seal materials 10*a*, 10*b* are made small and thereby sliding distances of the floating seal materials 10*a*, 10*b* relative to the frame 11 become small. Therefore, amounts of wear on contact faces of the floating seal materials 10*a*, 10*b* and the frame 11 can be reduced and life elongation of the floating seal materials 10*a*, 10*b* and the frame 11 can be realized.

According to the present embodiment like this, it is a matter of course that occurrence of wear on contact parts of mating members can be prevented by suppressing the possible movement of the floating seal materials 10*a*, 10*b* in the turbine circumferential direction and axial direction even when there exist vibrations caused by combustion and flowing of the combustion gas, and the turbine circumferential-direction position accuracy of the floating seal materials 10*a*, 10*b* can be maintained high, there is an effect of lowering NOx and preventing backfire owing to easy assembly and high seal performance and further the transmission piece of the gas turbine combustor which attains life elongation can be realized.

Embodiment 2

Figure 8:
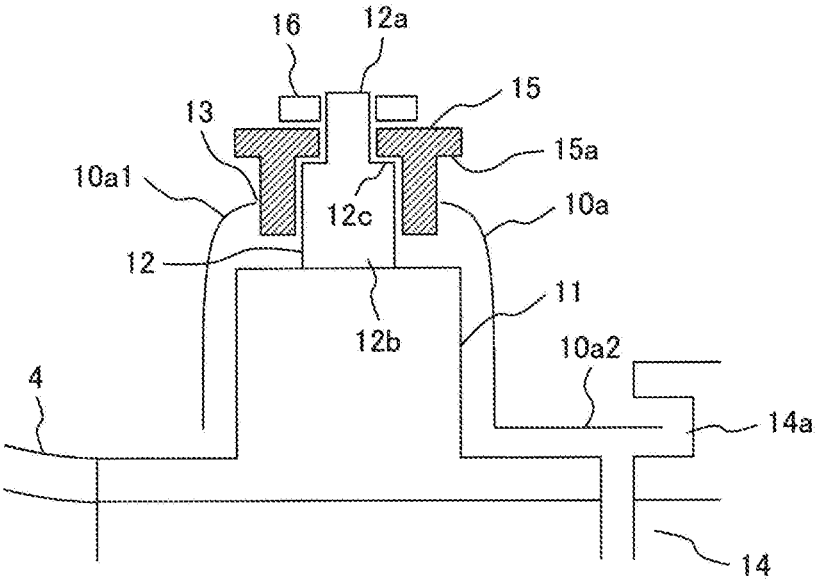
FIG. 8 is a partially enlarged diagram illustrating details of a joined part between a frame of a transition piece and a first-stage stator vane of the turbine which are adopted in an embodiment 2 of the gas turbine combustor of the present invention.
Figure 9:
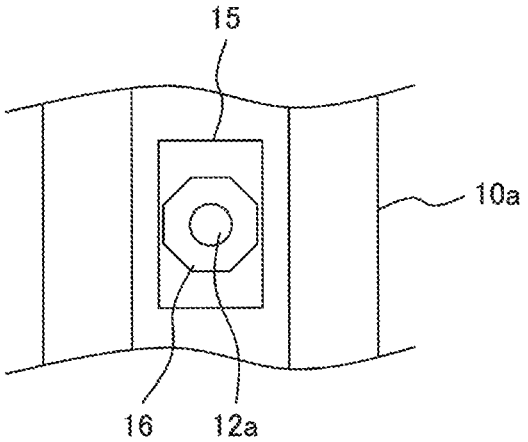
FIG. 9 is a plan view illustrating a state where a projection member which is installed on the frame of the transition piece in FIG. 8 is fitted into a through-hole formed in a seal material via a wear resistance piece.

Next, the embodiment 2 of the gas turbine combustor of the present invention will be described by using FIG. 8 and FIG. 9.

In the present embodiment illustrated in the drawings, it is characterized in that the projection member 12 is inserted into the through-hole 13 in the floating seal material 10*a* (10*b*) via a wear resistance piece 15 and thereby the floating seal material 10*a* (10*b*) is fixed.

Specifically, it has the projection member 12 which extends in the radius direction (the top-bottom direction in FIG. 8) of the transition piece 4, a radius-direction leading end part is made thinner than the frame 11 side and thereby a stepped part 12*c* is formed on this projection member 12, a male screw 12*a* is threaded in the leading end part of the projection member 12, a nut 16 is engaged with the male screw 12*a* portion and it is fastened therewith and thereby the floating seal material 10*a* (10*b*) is fixed to the stepped part 12*c* of the projection member 12 via the wear resistance piece 15 which is inserted into the leading end part of the projection member 12.

Further, a face 15*a* which prevents falling of the floating seal material 10*a* (10*b*) is formed on a face of the wear resistance piece 15 which is in contact with the stepped part 12*c* of the projection member 12 on the side opposite to a face which is fastened with the nut 16.

In addition, also in the present embodiment, similarly to the embodiment 1, the transition piece 4 is formed into the cylindrical shape at the inlet (the combustor liner side) of the combustion gas and into the inverted trapezoidal shape at the outlet (the turbine side), the frame 11 of the shape which matches the inverted trapezoidal shape of the outlet of the transition piece 4 is installed on the downstream side (the turbine side) of this transition piece 4 and the outlet side of the frame 11 which is formed into the inverted trapezoidal shape is connected to the first-stage stator vane part 14 (the turbine inlet part) on the turbine side. Then, the floating seal materials 10*a* (10*b*) are mounted on the upper and lower sides (the radial-direction inner side and outer side) of this frame 11 and the side seal materials 10*c*, 10*d* are mounted on the lateral sides thereof.

In addition, the floating seal material 10*a* (10*b*) of the present embodiment is configured by the fix part 10*a*1 (10*b*1) which is fixed to the frame 11 and the seal part 10*a*2 (10*b*2) which seals between the coupled parts of the transition piece 4 and the turbine similarly to the embodiment 1. The fix part 10*a*1 (10*b*1) is formed into, for example, the U-shape such as that illustrated in FIG. 8 which is the shape which arcuately curves along the protruded part which is provided on the radius-direction inner side and outer side of the frame 11. In addition, the through-hole 13 is formed in the fix part 10*a*1 (10*b*1) at the position where it corresponds to the aforementioned projection member 12 when mounted on the frame 11. In an example in FIG. 8, the through-hole 13 is formed at the position on the top part of the fix part 10*a*1 (10*b*1) which curves into the U-shape.

In addition, the seal part 10*a*2 (10*b*2) which seals the coupled parts of the transition piece 4 and the turbine inlet is connected to the downstream side (the right-hand side of FIG. 8) of the fix part 10*a*1 (10*b*1). This seal part 10*a*2 (10*b*2) is the engagement piece which bends at a right angle from the terminal part on the downstream side of the U-shaped fix part 10*a*1 (10*b*1) and extends to the downstream side along the outer surface of the outlet part of the frame 11.

Then, the seal groove 14*a* whose opening part is formed on the upstream side of the combustion gas flowing direction is provided in the face which faces the frame 11 on the turbine side. This seal groove 14*a* is formed in the face which faces the frame 11 by extending in the turbine circumferential direction. The downstream side of the seal part 10*a*2 (10*b*2) of the floating seal material 10*a* (10*b*) is inserted into the seal groove 14*a*. The seal part 10*a*2 (10*b*2) is fitted into this seal groove 14*a* and thereby the gap in the bonded part which is formed along the turbine circumferential direction is sealed. In addition, since the projection member 12 is fitted into the through-hole 13, the movement of the floating seal material 10*a* (10*b*) relative to the turbine circumferential direction can be restricted.

Thereby, it is structured in such a manner that the compressed air 100 is prevented from flowing into the turbine flow passage through the axial-direction gap between the coupled parts of the frame 11 on the downstream side of the transition piece 4 and the first-stage stator vane part 14 (see FIG. 8) on the gas turbine side and the floating seal material 10*a* (10*b*) does not fall off.

Further, a root part 12*b* of the projection member 12 in the present embodiment is formed into a rectangular parallelepiped shape and rounding is performed on a corner of a side face of this rectangular parallelepiped root part 12*b* of the projection member 12.

The possible movement of the floating seal material 10*a* (10*b*) in the turbine circumferential direction and axial direction is determined only by fitting faces of the through-hole 13 formed in the above-described floating seal material 10*a* (10*b*) and the wear resistance piece 15 and the fitting faces of the wear resistance piece 15 and the projection member 12.

Therefore, since the turbine circumferential-direction possible movement range, that is, the position accuracy of the floating seal material 10*a* (10*b*) can be managed only by management of the accuracy of the fitting faces of the aforementioned three members (the wear resistance piece 15, the projection member 12, the floating seal material 10*a* (10*b*)), suppression of the amount of the turbine circumferential-direction possible movement of the floating seal material 10*a* (10*b*) is facilitated by making into the structure of the present embodiment and it is advantageous for maintaining the position accuracy high.

In addition, when incorporating the transition piece 4 into the casing 2 of the gas turbine, even when the space in the casing 2 is small, the floating seal materials 10*a*, 10*b* and the side seal materials 10*c*, 10*d* can be incorporated thereinto by mounting in advance the floating seal materials 10*a*, 10*b* and the side seal materials 10*c*, 10*d* on the frame 11.

At this time, the gaps that the tolerance for incorporation is taken into consideration in the turbine circumferential direction are necessary between the adjacent floating seal materials 10*a*, 10*b* in order not to allow contact of the mating floating seal materials 10*a*, 10*b* of the adjacent combustor cans.

In the present embodiment, the position accuracy of the floating seal material 10*a* (10*b*) in the turbine circumferential direction can be maintained high by holding the floating seal materials 10*a* (10*b*) by fitting of the projection member 12 and the wear resistance piece 15 and the through-hole 13 and thereby the turbine circumferential-direction gap between the adjacent floating seal materials 10*a* (10*b*) can be made small. As a result, the sealability can be maintained high and the low NOx and the backfire prevention can be realized.

Further, the possible movement amount is made small by making the gap between the floating seal material 10*a* (10*b*) and the wear resistance piece 16 and the gap between the wear resistance piece 15 and the projection member 12 small and thereby the sliding distance of the floating seal material 10*a* (10*b*) relative to the frame 11 becomes small.

Therefore, the amounts of wear on the contact faces of the floating seal material 10*a* (10*b*) and the frame 11 can be reduced and the life elongation of the floating seal material 10*a* (10*b*) and the frame 11 can be realized.

In addition, the face 15*a* for preventing falling of the floating seal material 10*a* (10*b*) is formed on the wear resistance piece 15 and thereby falling of the floating seal material 10*a* (10B) can be prevented when incorporating the transition piece 4 and incorporation of the transition piece 4 is more facilitated.

In addition, since the wear resistance piece 15 is fixed with the male screw 12*a* and the nut 16, detachment of the floating seal material 10*a* (10*b*) and the wear resistance piece 15 is easy in comparison with fixing by welding. In particular, on a site of the gas turbine, the floating seal material 10*a* (10*b*) and the wear resistance piece 15 can be replaced with other ones with no need of a welding technology and short-time and low-cost maintenance can be realized.

In addition, since contact between the projection member 12 and the floating seal material 10*a* (10*b*) can be prevented by the wear resistance piece 15 and a contact area of a member which is in contact with the projection member 12 can be made large in comparison with a case of the floating seal material 10*a* (10*b*), a surface pressure on the fitting face of the projection member 12 can be made small, an amount of wear damage on the projection member 12 is reduced and the life thereof can be elongated.

Further, it is desirable to select a combination of materials of the wear resistance piece 15, the floating seal material 10*a* (10*b*) which is advantageous for wear resistance and, for example, the combination of mating HS25 and HS25 is given. HS25 is carbide-precipitation-strengthened type cobalt-based alloy (L605, AMS-5537/AMS-5796, UNS R30605). In addition, it is also desirable to select the combination which is advantageous for the wear resistance as the combination of the materials of the wear resistance piece 15 and the projection member 12 and, for example, the mating HS25 and HS25 are given.

According to the present embodiment like this, it is a matter of course that occurrence of the wear on the contact parts of the mating members can be prevented by suppressing the possible movement of the floating seal materials 10*a*, 10*b* in the turbine circumferential direction and axial direction even when there exist the vibrations caused by combustion and flowing of the combustion gas, and the turbine circumferential-direction position accuracy of the floating seal materials 10*a*, 10*b* can be maintained high, there is the effect of lowering NOx and preventing the backfire owing to the easy assembly and the high seal performance and further the transmission piece of the gas turbine combustor which attains the life elongation can be realized.

Embodiment 3

Figure 11:
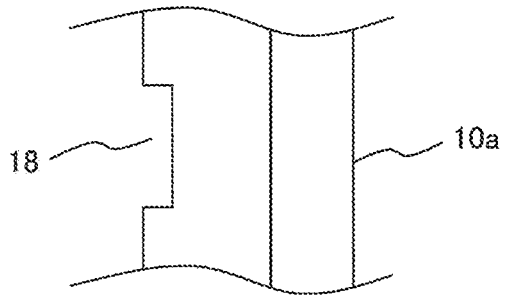
FIG. 11 is a diagram illustrating a seal material which is adopted in the embodiment 3 of the gas turbine combustor of the present invention.
Figure 12:
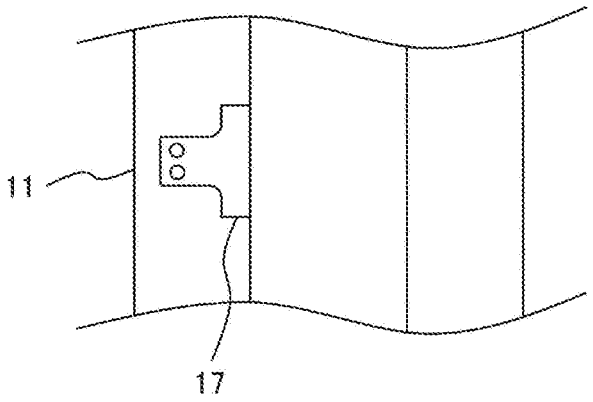
FIG. 12 is a plan view illustrating a state where a projection member which is installed on a frame of a transition piece in FIG. 11 is fitted into a notch formed in the seal material.

Next, the embodiment 3 of the gas turbine combustor of the present invention will be described by using FIG. 10, FIG. 11 and FIG. 12.

In the present embodiment illustrated in the drawings, it is characterized in that a projection member 17 which extends to the combustor liner side (a left-hand direction in FIG. 10) which is the upstream side of a gas distribution direction of the transition piece 4 is provided on the outer circumference of the frame 11, a notch 18 which matches this projection member 17 is formed in the floating seal material 10*a* (10*b*), the projection member 17 is fitted into the notch 18 in the floating seal material 10*a* (10*b*) and thereby the floating seal material 10*a* (10*b*) is fixed.

Figure 10:
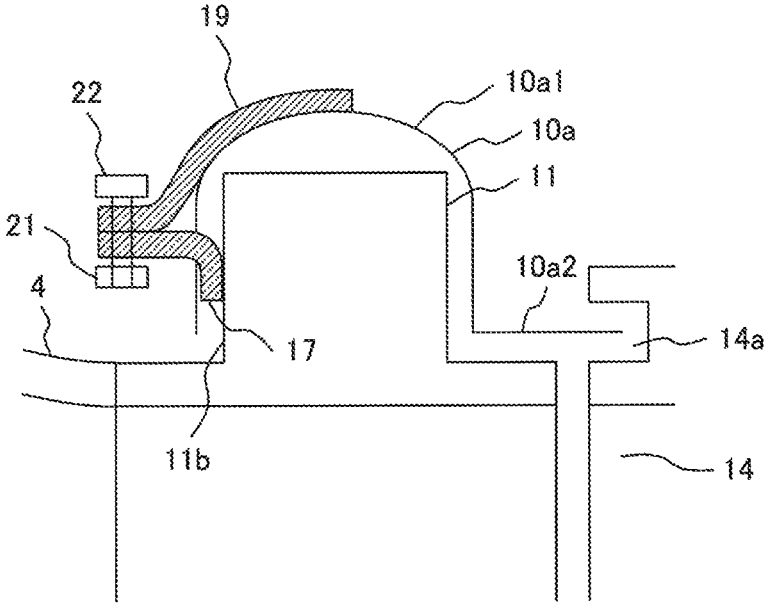
FIG. 10 is a partially enlarged diagram illustrating details of a joined part between a frame of a transition piece and a first-stage stator vane of the turbine which are adopted in an embodiment 3 of the gas turbine combustor of the present invention.

In addition, in the present embodiment, a bolt-use hole is formed in a leading end of the projection member 17 and further it is equipped with a fall prevention piece 19 that one side covers part of the floating seal material 10*a* (10*b*) and thereby prevents falling of the floating seal material 10*a* (10*b*) in a radius direction (an upward direction in FIG. 10)

of the transition piece 4 and other side end is fixed together with the projection member 17 with a bolt and a nut 21 via the bolt-use hole.

Incidentally, the projection member 17 which extends to the combustor liner side of the transition piece 4 is formed integrally with the frame 11 or is fixed to the frame 11 by welding.

In addition, also in the present embodiment, similarly to the embodiments 1 and 2, the transition piece 4 is formed into the cylindrical shape at the inlet (the combustor liner side) of the combustion gas and into the inverted trapezoidal shape at the outlet (the turbine side), the frame 11 of the shape which matches the inverted trapezoidal shape of the outlet of the transition piece 4 is installed on the downstream side (the turbine side) of this transition piece 4 and the outlet side of the frame 11 which is formed into the inverted trapezoidal shape is connected to the first-stage stator vane part 14 (the turbine inlet part) on the turbine side. Then, the floating seal materials 10*a* (10*b*) are mounted on the upper and lower sides (the radial-direction inner side and outer side) of this frame 11 and the side seal materials 10*c*, 10*d* are mounted on the lateral sides thereof.

In addition, the above-described floating seal material 10*a* (10*b*) is configured by the fix part 10*a*1 (10*b*1) which is fixed to the frame 11 and the seal part 10*a*2 (10*b*2) which seals between the coupled parts of the transition piece 4 and the turbine similarly to the embodiments 1 and 2. The fix part 10*a*1 (10*b*1) is formed into, for example, the U-shape such as that illustrated in FIG. 10 which is the shape which arcuately curves along the protruded part which is provided on the radius-direction outer side and inner side of the frame 11. In addition, the notch 18 is formed in the fix part 10*a*1 (10*b*1) at the position where it corresponds to the aforementioned projection member 17 when mounted on the frame 11. In an example in FIG. 10, the notch 18 is formed at a lateral position of the fix part 10*a*1 (10*b*1) which curves into the U-shape.

In addition, the seal part 10*a*2 (10*b*2) which seals the coupled parts of the transition piece 4 and the turbine inlet is connected to the downstream side (the right-hand side of FIG. 10) of the fix part 10*a*1 (10*b*1). This seal part 10*a*2 (10*b*2) is the engagement piece which bends at a right angle from the terminal part on the downstream side of the U-shaped fix part 10*a*1 (10*b*1) and extends to the downstream side along the outer surface of the outlet part of the frame 11.

Then, the seal groove 14*a* whose opening part is formed on the upstream side of the combustion gas flowing direction is provided in the face which faces the frame 11 on the turbine side. This seal groove 14*a* is formed in the face which faces the frame 11 by extending in the turbine circumferential direction. The downstream side of the seal part 10*a*2 (10*b*2) of the floating seal material 10*a* (10*b*) is inserted into the seal groove 14*a*. The seal part 10*a*2 (10*b*2) is fitted into this seal groove 14*a* and thereby the gap in the bonded part which is formed along the turbine circumferential direction is sealed. In addition, since the projection member 17 is fitted into the notch 18, the movement of the floating seal material 10*a* (10*b*) relative to the turbine circumferential direction can be restricted.

Thereby, it is structured in such a manner that the compressed air 100 is prevented from flowing into the turbine flow passage through the axial-direction gap between the coupled parts of the frame 11 on the downstream side of the transition piece 4 and the first-stage stator vane part 14 (see FIG. 10) on the gas turbine side and the floating seal material 10*a* (10*b*) does not fall off.

As described above, the bolt-use hole used for attaching the fall prevention piece 19 is provided in the leading end of the projection member 17, the fall prevention piece 19 is fixed together with the projection member 17 with the bolt 22 and the nut 21 via the bolt-use hole and falling of the floating seal material 10*a* (10*b*) in the radial direction is prevented by the fall prevention piece 19.

Incidentally, the floating seal material 10*a* (10*b*) may be pressed against the first-stage stator vane part 14 side on the axial-direction turbine side by the fall prevention piece 19 so as to bring the floating seal material 10*a* (10*b*) into contact with an axial-direction combustor-side side face 11*b* of the frame 11.

In the present embodiment, the turbine circumferential-direction possible movement of the floating seal material 10*a* (10*b*) is suppressed by fitting of the projection member 17 and the notch 18 formed in the floating seal material 10*a* (10*b*).

That is, since the turbine circumferential-direction possible movement of the floating seal material 10*a* (10*b*) is determined only by the fitting faces of the notch 18 formed in the floating seal material 10*a* (10*b*) and the projection member 17, the turbine circumferential-direction possible movement range, that is, the position accuracy of the floating seal material 10*a* (10*b*) can be managed only by management of the accuracy of the fitting faces of the notch 18 and the projection member 17.

Therefore, suppression of the amount of the turbine circumferential-direction possible movement of the floating seal material 10*a* (10*b*) is facilitated by forming into the structure of the present embodiment and it is advantageous for maintaining the position accuracy high.

In addition, when incorporating the transition piece 4 into the casing 2 of the gas turbine, even when the space in the casing 2 is small, the floating seal materials 10*a*, 10*b* and the side seal materials 10*c*, 10*d* can be incorporated thereinto by mounting in advance the floating seal materials 10*a*, 10*b* and the side seal materials 10*c*, 10*d* on the frame 11.

At this time, the gaps that the tolerance for incorporation is taken into consideration in the turbine circumferential direction are necessary between the adjacent floating seal materials 10*a*, 10*b* in order not to allow contact of the mating floating seal materials 10*a*, 10*b* of the adjacent combustor cans.

Since in the present embodiment, the floating seal material 10*a* (10*b*) is held by fitting of the projection member 17 and the notch 18, the position accuracy of the floating seal material 10*a* (10*b*) in the turbine circumferential direction can be maintained high and the turbine circumferential-direction gap between the adjacent floating seal materials 10*a* (10*b*) can be made small. As a result, the sealability can be maintained high and the low NOx and the backfire prevention can be realized.

Further, the possible movement amount of the floating seal material 10*a* (10*b*) is made small and thereby the sliding distance of the floating seal material 10*a* (10*b*) relative to the frame 11 becomes small. Therefore, the amounts of wear on the contact faces of the floating seal material 10*a* (10*b*) and the frame 11 can be reduced and the life elongation of the floating seal material 10*a* (10*b*) and the frame 11 can be realized.

In addition, since the floating seal material 10*a* (10*b*) does not fall off by the fall prevention piece 19 when incorporating the transition piece 4, incorporation of the transition piece 4 is more facilitated.

In addition, since the fall prevention piece 19 is fixed to the leading end of the projection member 17 together with the projection member 17 with the bolt 22 and the nut 21, detachment of the fall prevention piece 19 and the floating seal material 10*a* (10*b*) is easy in comparison with fixing by welding. In particular, on the site of the gas turbine, the floating seal material 10*a* (10*b*) and the fall prevention piece 19 can be replaced with other ones with no need of the welding technology and the short-time and low-cost maintenance can be realized.

In addition, when the floating seal material 10*a* (10*b*) is pressed against the first-stage stator vane part 14 side on the axial-direction turbine side by the fall prevention piece 19 so as to bring the floating seal material 10*a* (10*b*) into contact with the frame 11, the axial-direction possible movement of the floating seal material 10*a* (10*b*) relative to the frame 11 is suppressed.

Thereby, since the distance of sliding of the floating seal material 10*a* (10*b*) relative to the frame 11 becomes small, the wear amounts of the floating seal material 10*a* (10*b*) and the frame 11 become small and thereby the life elongation of the floating seal material 10*a* (10*b*) and the frame 11 can be realized.

In addition, in a case where the floating seal material 10*a* (10*b*) is pressed against the first-stage stator vane part 14 side on the axial-direction turbine side by the fall prevention piece 19 so as to bring the floating seal material 10*a* (10*b*) into contact with the frame 11, since the gap on the axial-direction combustor liner side is closed in the gaps between the frame 11 and the floating seal material 10*a* (10*b*), a leak path of the compressed air 100 becomes small. Thereby, the sealability is improved and the low NOx and the backlash prevention can be realized.

Further, it is desirable to select the combination of the materials of the projection member 17 and the floating seal material 10*a* (10*b*) which is advantageous for the wear resistance and, for example, the combination of the mating HS25 and HS25 is given.

According to the present embodiment like this, it is a matter of course that even when there exist the vibrations caused by combustion and flowing of the combustion gas, occurrence of the wear on the contact parts of the mating members can be prevented by suppressing the possible movement of the floating seal materials 10*a*, 10*b* in the turbine circumferential direction and axial direction, and the turbine circumferential-direction position accuracy of the floating seal materials 10*a*, 10*b* can be maintained high, there is the effect of lowering NOx and preventing the backfire owing to the easy assembly and the high seal performance and further the transmission piece of the gas turbine combustor which attains the life elongation can be realized.

Incidentally, the present invention is not limited to the above-described embodiments and various modified examples are included. For example, the above-described embodiments are the ones described in detail for the purpose of comprehensively describing the present invention and it is not necessarily limited to the one which is equipped with all the configurations which have been described. In addition, it is possible to replace part of a configuration of one embodiment with a configuration of another embodiment and it is also possible to add a configuration of another embodiment to a configuration of one embodiment. In addition, it is possible to add, delete and replace another configuration to, from and with part of one configuration of each embodiment.

REFERENCE SIGNS LIST

1 . . . diffuser, 2 . . . casing, 4 . . . transition piece, 5 . . . transition piece flow sleeve, 6 . . . liner, 7 . . . liner flow sleeve, 8 . . . combustion chamber, 9 . . . flow passage formed by the transition piece and the transition piece flow sleeve, 10 . . . seal member, 10*a*, 10*b* . . . floating seal material, 10*c*, 10*d* . . . side seal material, 10*a*1, 10*b*1 . . . fix part of the floating seal material, 10*a*2, 10*b*2 . . . seal part of the floating seal material, 11 . . . frame, 12, 17 . . . projection member, 12*a* . . . male screw of the projection member, 12*b* . . . root part of the projection member, 12*c* . . . stepped part of the projection member, 13 . . . through-hole, 14 . . . turbine-side first-stage stator vane part, 14*a* . . . seal groove, 15 . . . wear resistance piece, 15*a* . . . face of the wear resistance piece for preventing falling of the floating seal material, 16, 21 . . . nut, 18 . . . notch, 19 . . . fall prevention piece, 22 . . . bolt, 100 . . . compressed air, 105, 106 . . . flame, 107, 108 . . . combustion gas, 200, 201 . . . fuel system, 300 . . . compressor, 301 . . . turbine, and 302 . . . power generator.

The invention claimed is:

1. A gas turbine combustor comprising:

a transition piece;

a transition piece flow sleeve provided around the transition piece;

a liner connected to the transition piece; and a liner flow sleeve provided around the liner, wherein the transition piece is provided with a frame abutting a downstream side of the transition piece and a seal installed on a coupled part of the frame and a turbine-side stator vane part, the seal blocking flowing of compressed air from a compressor into a turbine side through a gap of the coupled part, wherein a projection is provided on an outer circumference of the frame, the projection extending to an upstream side of the frame relative to a gas flow direction of the transition piece, wherein a notch is formed in the seal, and the projection is fitted into the notch so as to suppress a movement of the seal in a turbine circumferential direction, thereby fixing the seal to the frame.

2. The gas turbine combustor according to claim 1, wherein a bolt-use hole is formed in a leading end part of the projection, a fall prevention piece is provided at the projection, and one side of the fall prevention piece covers a part of the seal thereby preventing falling of the seal in a radial direction of the transition piece and one end of the fall prevention piece is fixed together with the projection with a bolt and a nut via the bolt-use hole.

3. The gas turbine combustor according to claim 1, wherein the projection is formed integrally with the frame or is fixed to the frame by welding.

4. A gas turbine combustor, comprising:

a transition piece;

a transition piece flow sleeve provided around the transition piece;

a liner connected to the transition piece; and a liner flow sleeve provided around the liner, wherein the transition piece is provided with a frame installed on a downstream side of the transition piece and a seal installed on a coupled part of the frame and a turbine-side stator vane part, the seal blocking flowing of compressed air from a compressor into a turbine side through a gap of the coupled part, wherein a projection is provided on an outer circumference of the frame, the projection extending to an upstream side of the frame relative to a gas flow direction of the transition piece, wherein a notch is provided on the seal and matches the projection, wherein the projection is fitted into the notch so as to suppress a movement of the seal, thereby fixing the seal to the frame, wherein the seal includes floating seals and side seals, the transition piece is formed into a cylindrical shape at an inlet of a combustion gas and into an inverted-trapezoidal shape at an outlet thereof, the frame, which is of a shape that matches the inverted-trapezoidal shape of the outlet of the transition piece, is installed on the downstream side of the transition piece, an outlet side of the frame which is formed into the inverted-trapezoidal shape is connected to the turbine-side stator vane part, and the floating seals are mounted on an upper side and a lower side of the frame and the side seals are mounted on lateral sides thereof, the notch is formed in at least one of the floating seals, the projection is fitted into the notch, thereby fixing the at least one of the floating seals to the frame, the floating seals are configured by a fix part which is fixed to the frame and a seal part which seals between the coupled part of the frame and the turbine-side stator vane part and the seal part is fitted into a seal groove which is formed in the turbine-side stator vane part.

5. A transition piece assembly of a combustor, comprising:

a transition piece;

a frame abutting a downstream side of the transition piece; and a seal installed on a coupled part of the frame and a turbine-side stator vane part, the seal blocking flowing of compressed air from a compressor to a turbine side through a gap of the coupled part;

wherein a projection is provided on an outer circumference of the frame, the projection extending to an upstream side of the frame relative to a gas flow direction of the transition piece, a notch is formed in the seal, and the projection is fitted into the notch so as to suppress a movement of the seal in a turbine circumferential direction, thereby fixing the seal to the frame.

* * * * *